US008106777B2

(12) United States Patent
Soto et al.

(10) Patent No.: US 8,106,777 B2
(45) Date of Patent: Jan. 31, 2012

(54) METHOD AND SYSTEM TO NEGATE INTERFERENCE FROM ADJACENT TRANSMITTERS IN AN ELECTRONIC ARTICLE SURVEILLANCE SYSTEM

(75) Inventors: Manuel A. Soto, Lake Worth, FL (US); Adam S. Bergman, Boca Raton, FL (US); Brent F. Balch, Oakland Park, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 488 days.

(21) Appl. No.: 12/425,828

(22) Filed: Apr. 17, 2009

(65) Prior Publication Data

US 2009/0289770 A1 Nov. 26, 2009

Related U.S. Application Data

(60) Provisional application No. 61/128,787, filed on May 22, 2008.

(51) Int. Cl.
*G08B 13/14* (2006.01)

(52) U.S. Cl. ..... 340/572.1; 340/568.1; 340/10.1; 455/63.1

(58) Field of Classification Search ..... 340/572.1, 340/568.1, 10.1, 5.92; 375/356; 455/63.1
See application file for complete search history.

(56) References Cited

U.S. PATENT DOCUMENTS

| | | | |
|---|---|---|---|
| 6,201,469 | B1 | 3/2001 | Balch et al. |
| 6,750,768 | B2 | 6/2004 | Yang et al. |
| 7,202,784 | B1 | 4/2007 | Herwig |
| 7,212,117 | B2 | 5/2007 | Frederick et al. |

OTHER PUBLICATIONS

International Search Report and Written Opinion dated Jul. 29, 2009 for International Application No. PCT/US2009/002554, International Filing Date Apr. 24, 2009 (10-pages).

*Primary Examiner* — Jennifer Mehmood
*Assistant Examiner* — Hongmin Fan
(74) *Attorney, Agent, or Firm* — Alan M. Weisberg; Christopher & Weisberg, P.A.

(57) ABSTRACT

A method and electronic article surveillance ("EAS") system reduce interference. The EAS system includes a detection zone. At least one reference pattern of transmission windows for an interfering EAS system is provided. The reference pattern indicates a sequence of time slots for which the interfering EAS system is transmitting. A sample pattern of signals is received. Each signal has a corresponding amplitude. The received sample pattern is compared to the at least one reference pattern. Responsive to determining that the received sample pattern matches the at least one reference pattern, the at least one reference pattern is used to trim samples received during receive windows corresponding to the time slots for which the interfering EAS system is transmitting.

19 Claims, 4 Drawing Sheets

TX = TRANSMIT WINDOW
RX = RECEIVE WINDOW

METHOD AND SYSTEM TO NEGATE INTERFERENCE FROM ADJACENT TRANSMITTERS IN AN ELECTRONIC ARTICLE SURVEILLANCE SYSTEM

CROSS-REFERENCE TO RELATED APPLICATION

The present invention is related to and claims priority to U.S. Provisional Patent Application No. 61/128,787, filed May 22, 2008, entitled METHOD TO NEGATE INTERFERENCE FROM ADJACENT TRANSMITTERS IN AN ELECTRONIC ARTICLE SURVEILLANCE SYSTEM, the entire contents of which is incorporated herein by reference.

STATEMENT REGARDING FEDERALLY SPONSORED RESEARCH OR DEVELOPMENT n/a

FIELD OF THE INVENTION

The present invention relates generally to electromagnetic signal transmitters used in electronic article surveillance ("EAS") systems, and more specifically the control of EAS transmitters to reduce interference.

BACKGROUND OF THE INVENTION

Electronic Article Surveillance ("EAS") systems are designed to prevent unauthorized removal of an item from a controlled area. For example, EAS systems are often implemented at retail sales locations to deter theft and notify authorized personnel when shoplifting occurs. A typical EAS system may include a monitoring system and one or more security tags. The monitoring system may create an interrogation zone at an access point for the controlled area, e.g., at entry/exit doors in a retail store. A security tag may be fastened to an item, such as an article of clothing. If an active tag then enters the interrogation zone, an alarm may be triggered indicating unauthorized removal of the tagged item from the controlled area.

In many environments, there are a number of different EAS systems implemented simultaneously. Examples of such environments include small stores arranged, for example, in a conventional mall, strip mall or shopping plaza. As shown in FIG. 1, each EAS system generally operates by alternating periods of transmission, reception and idle or "sleep" time where the EAS system is not attempting to detect security tags, but may perform various processing or operational functions. In one known system, the EAS system operates at a frequency of 1.5 times the power line frequency, e.g., 90 Hz for a 60 Hz line frequency or 75 Hz for a 50 Hz line frequency and timing the beginning of transmit or receive windows with the zero-crossing point of the power line. During a "transmit" window, the EAS system does not receive and vice versa. However, the detection capability of an EAS system can be greatly reduced due to interference signals created by other nearby EAS systems having an "out of phase" transmitter operating during the "receive" window.

Historically, EAS transmitters in close proximity to each other have been synchronized to avoid these adverse interactions. This compatibility has been accomplished using several different levels of synchronization. For example, the carrier oscillators or the modulating waveform of transmitters can be synchronized. In more complex systems, such as those sold by Sensormatic Electronics Corporation under the trademark ULTRA*MAX®, a transmitter configuration sequence may be synchronized between multiple systems.

U.S. Pat. No. 6,201,469, for example, provides for synchronization of the transmitter configuration sequence using a power line zero crossing function for which the phase is manually adjusted, the entire contents of which are hereby incorporated by reference. U.S. Pat. No. 7,212,117 provides for a wireless phase locked loop ("PLL") system for synchronizing the transmit carrier's modulating waveform, the entire contents of which are hereby incorporated by reference. U.S. patent application Ser. No. 11/729,372 provides a system for synchronization that utilizes a synchronization master signal that is generated from a global positioning satellite reference signal, the entire contents of which are hereby incorporated by reference.

Without this synchronization, EAS systems positioned within a certain proximity of one another may interfere with one another's receivers, thereby decreasing sensitivity, causing false alarms, or even rendering the system inoperable. This interference may, in turn, result in service calls to local technicians. The technicians then have to come to the site of the installed system and manually adjust the timing of the systems. A persistent or repetitive problem results in many duplicative service calls causing great expense and aggravation. Additionally, the interfering system may be inaccessible to the service personnel, thus it may not even be possible to synchronize the interfering system.

Further enhancing the problem, not all EAS systems available today utilize synchronization. The issue is even further complicated in that some unsynchronized EAS systems also utilize the random transmission of pulses in a non-periodic manner. One such system is described in U.S. Pat. No. 6,750,768. Use of an unsynchronized EAS system further increases the probability that these systems may interfere with each other and with synchronized systems as more and more of such systems are operated in close proximity with each other.

Therefore, what is needed is a system and method for reducing interference among close proximity EAS transmitters without the need for synchronizing between the individual transmitters.

SUMMARY OF THE INVENTION

The present invention advantageously provides a method and system for reducing interference from adjacent transmitters in an electronic article surveillance ("EAS") system. Generally, embodiments of the present invention determine a transmit pattern and/or energy levels of received signals and prevent the EAS system from using received signals to detect EAS tags or perform noise calculations during the time that an adjacent EAS system is transmitting.

In accordance with one aspect of the present invention, a method is provided for reducing interference in an EAS system. The EAS system includes a detection zone. At least one reference pattern of transmission windows for an interfering EAS system is provided. The reference pattern indicates a sequence of time slots for which the interfering EAS system is transmitting. A sample pattern of signals is received. Each signal has a corresponding amplitude. The received sample pattern is compared to the at least one reference pattern. Responsive to determining that the received sample pattern matches the at least one reference pattern, the at least one reference pattern is used to trim samples received during receive windows corresponding to the time slots for which the interfering EAS system is transmitting.

In accordance with another aspect of the present invention, another method is provided for reducing interference in EAS system. The EAS system includes a detection zone. A plurality of signals is received. Each signal has a corresponding amplitude. If the amplitude of at least one received signal exceeds a predetermined threshold, the received signal that has an amplitude that exceeds the predetermined threshold is discarded, and an EAS tag is determined to be present in the detection zone by considering only the non-discarded signals.

In accordance with yet another aspect of the present invention, an EAS system includes a transmitter, a receiver, a memory and a controller. The transmitter is operable to transmit interrogation signals to excite an EAS tag within a detection zone. The receiver is operable to receive a sample pattern of signals. Each signal has a corresponding amplitude. The memory includes at least one reference pattern of transmission windows for an interfering EAS system. The reference pattern indicates a sequence of time slots for which the interfering EAS system is transmitting. The controller is electrically coupled to the transmitter, the receiver, and the memory. The controller is operable to compare the received sample pattern to the reference pattern and, if the received sample pattern matches the reference pattern, use the reference pattern to trim samples received during receive windows corresponding to the time slots for which the interfering EAS system is transmitting.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
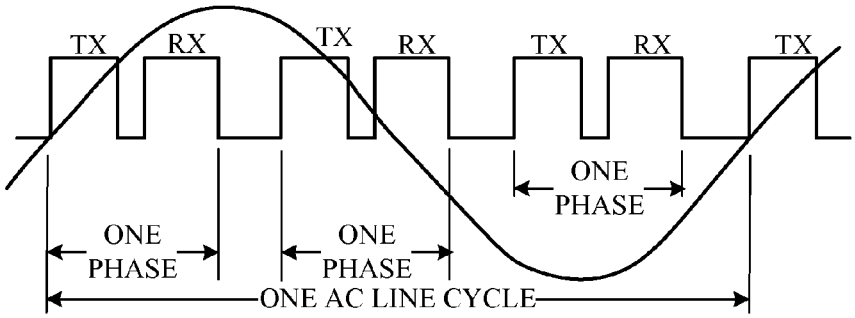
FIG. 1 PRIOR ART
FIG. 1 is a graph illustrating a transmit/receive sequence of a prior art electronic article surveillance ("EAS") system synchronized with the power cycle of an AC power line.

Before describing in detail exemplary embodiments that are in accordance with the present invention, it is noted that the embodiments reside primarily in combinations of apparatus components and processing steps related to implementing a system and method for reducing interference among close proximity EAS transmitters without the need for synchronizing the individual transmitters to each other.

Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a method and system for negating or reducing the interference produced by neighboring EAS transmitters located adjacent or in close proximity with the EAS system. The method and system reduces this interference by recognizing the transmitting pattern of the interfering system and ignoring any signals received during a time that the interfering system is transmitting.

Figure 2:
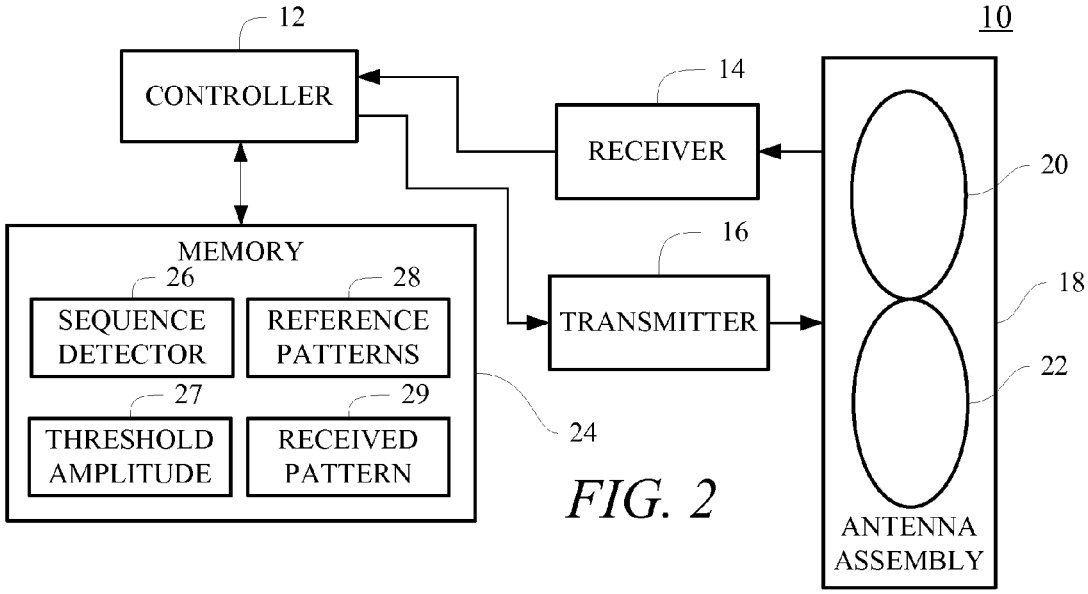
FIG. 2 is a block diagram of an exemplary EAS system constructed in accordance with the principles of the present invention.

Referring now to the drawing figures in which like reference designators refer to like elements, there is shown in FIG. 2 an exemplary EAS system provided in accordance with the principles of the present invention and designated generally as "10". EAS system 10 includes an electronic controller circuit 12, which can include a microprocessor, electrically connected to both a receiver circuit 14 and a transmitter circuit 16. The transmitter circuit 16 transmits interrogation signals within an interrogation zone to excite EAS tags, causing the EAS tag to produce a response signal. The receiver circuit 14 receives the response signals from an EAS tag to detect the EAS tag within the interrogation zone. The receiver circuit 14 and the transmitter circuit 16 are electrically connected to an antenna assembly 18. The antenna assembly 18 may include two separate antenna coils, an upper coil 20 and a lower coil 22, both of which, or any one, may be used to transmit and receive signals. The antenna assembly 18 may have one or more coils 20, 22 serving as the receiving antenna and one or more coils 20, 22 serving as the transmitting antenna. Alternatively, the antenna assembly 18 can include one or more coils 20, 22 serving as both the receiving and transmitting antennas.

Signals from a receiving antenna are amplified, filtered and detected by the receiver circuit 14, which supplies both amplitude and frequency information to the controller 12. Based on design constraints, which may include program instructions in firmware, the controller 12 has the ability to transmit signals of various frequencies, at particular times and for particular durations to the system 10 environment through the transmitter circuit 16, electrically connected to a transmitting antenna 18.

The controller 12 communicates with a memory 24 containing a sequence detector 26, a threshold amplitude 27, a set of reference patterns 28 for other EAS systems and a current pattern 30 of signals received by the receiver 14. The sequence detector 26 determines the current pattern 30 of interfering signals by retaining only those signals above the threshold amplitude 27 and instructs the controller 12 to ignore any signals received when the interfering system is transmitting accordingly. In one embodiment, each of the references patterns 28 and the current pattern 30 may be represented as a series of bits wherein each bit represents one window. A bit may be set to a "1" if the transmitter operates during that window or set to a "0" if the transmitter is not operating in the corresponding window. The set of reference patterns 28 may include both full reference sequences, i.e., patterns using both an aiding and a figure-8 configuration, and aiding sequences, i.e., patterns using only an aiding configuration. Operation of the sequence detector 26 is discussed in greater detail below.

Figure 3:
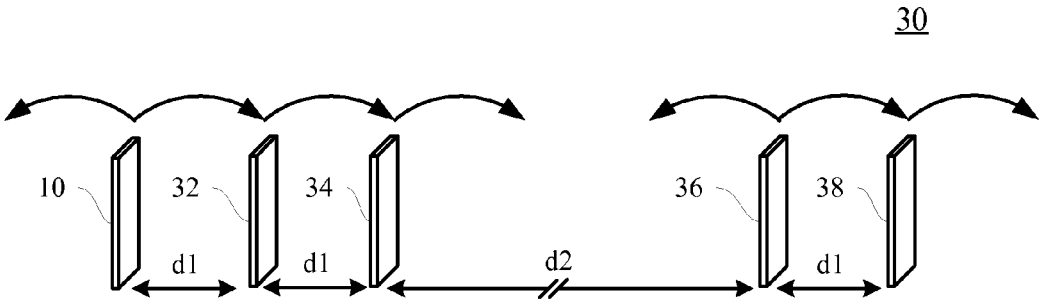
FIG. 3 illustrates multiple EAS systems operating in close proximity of one another in accordance with the principles of the present invention.

FIG. 3 illustrates an exemplary multiple EAS system 30 that may be utilized in an embodiment of the invention. FIG. 3 shows antenna assemblies 18 from several independent EAS systems 10, 32, 34, 36 and 38. Three of the systems 10, 32 and 34 are each separated by a distance no greater than a limiting distance d1. Two systems 36 and 38 are also mutually separated by a distance no greater than the limiting distance d1. Systems 34 and 36 are separated by a distance d2, which is greater than the limiting distance d1. Each of these independent systems follows the same predefined pattern of transmission and reception intervals, including various permutations of transmission frequency and antenna phase. It is possible for receiving antennas to detect signals from other transmitting antennas in a radius of up to 500 ft.

Many EAS systems do not typically begin transmitting immediately at power-up, but engage in a synchronization process to ensure that they are not transmitting at a time that another the receiver of another system is "listening" for the response signal from and EAS marker. In such systems, the transmitters are synchronized to be "in-phase" with each other to avoid such interference. This phase alignment may need to be adjusted from time to time, as is known in the art, if the transmitters fall "out of phase" with each other.

Even if these systems remain in phase, if other unsynchronized systems and systems using non-periodic transmission pulses are operated in proximity to the synchronized EAS system, then it is possible that one or more of these other EAS systems will be transmitting when the receiver of another system is listening, causing unwanted interference and a risk of false alarms and other system issues. However, in most cases, the amplitude and energy of the signal provided by an "out of phase" transmitter will be higher than the amplitude of the response signal from an EAS marker. Therefore, an amplitude discrimination technique may be used to disregard these interfering transmitter signals. A signal amplitude (or an energy) threshold higher than the anticipated amplitude of a response signal from an EAS marker may be set by hardware and/or software of electronic controller circuit 12. If the amplitude of a detected signal is higher than the threshold, the detector will ignore that particular received sample and not use it for detection statistics.

In some cases, the interfering transmitter may transmit a repetitive pattern that uses a combination of aiding ("Figure-0") and Figure-8 transmit pulses, wherein the two coils 20, 22 which constitute the system's transmitter antenna 18 alternately reverse their phase relationship between 0° (also referred to as "in-phase") and 180° (also referred to as "substantially out-of-phase") operation. Figure-8 amplitudes may be much lower than the amplitude of a response signal from a marker (and thus lower than the predetermined amplitude threshold), and so the system may not ignore these received samples and the performance could be degraded. However, if the interfering transmit pattern is repetitive, a pattern recognition technique can be used to identify these signals.

In one embodiment, the system 10 may only evaluate signal amplitudes over the threshold. Once the pattern is recognized, all of the interfering received samples (both under and over the threshold) can be ignored. Thus, for the case of an "out of phase" transmitter composed of Figure-0 and Figure-8 components, depending on the distance, only the aiding signal may exceed the threshold. Once the pattern of the aiding signal is recognized, the Figure-8 components may also be automatically ignored even though they may not be separately recognized via the threshold test. Additionally, an adaptive scheme could be introduced to automatically set the limits for the threshold dependent on signals received.

Figure 4:
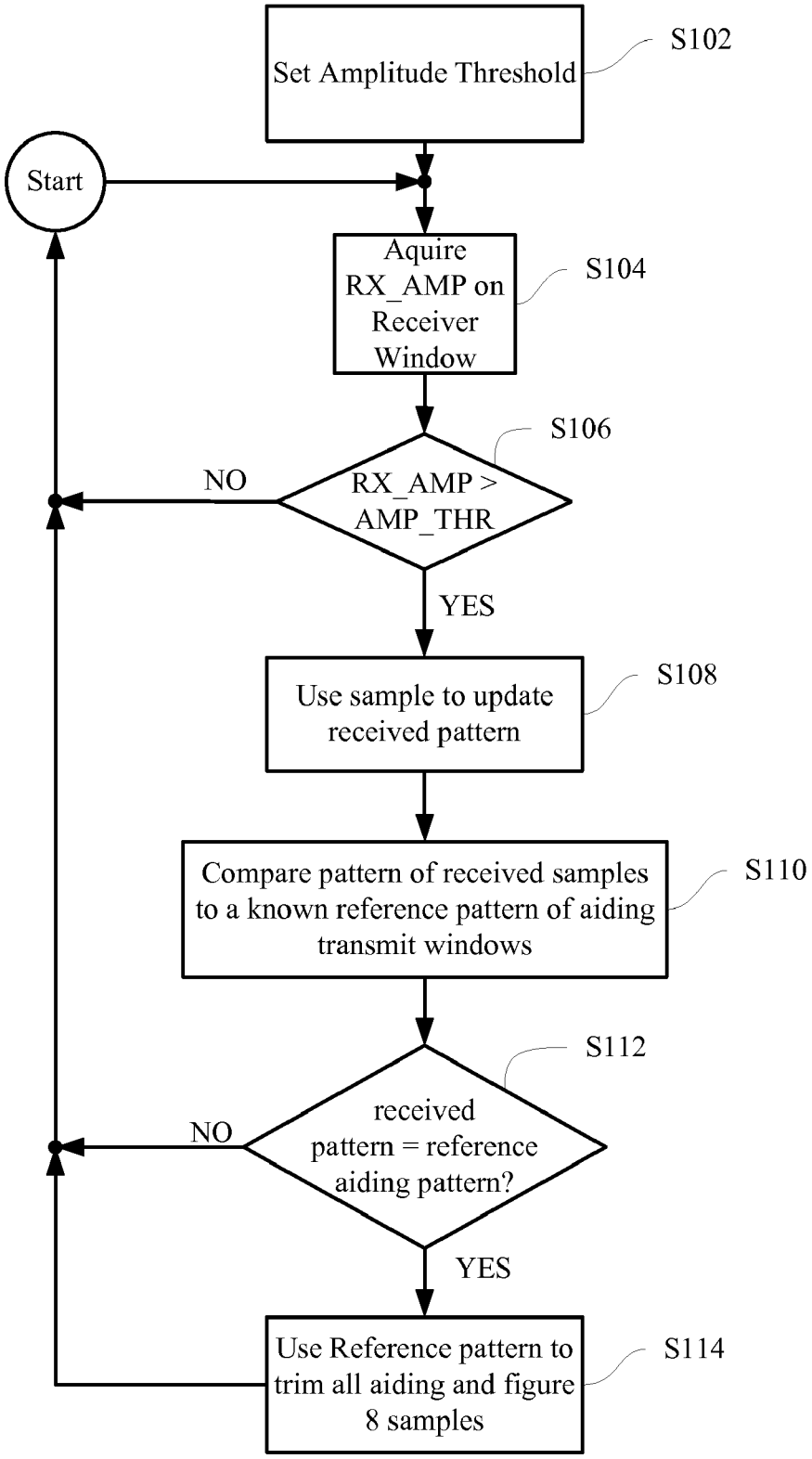
FIG. 4 is a flow chart of an exemplary out-of-phase transmitter sequence detection and trim process according to the principles of the present invention.

Referring now to FIG. 4, an exemplary operational flowchart is provided that describes steps performed by the sequence detector 26 for deciding when to terminate data collection from a serial connection and begin an RF transmission, in accordance with the principles of the present invention. The threshold amplitude 27, AMP_THR, for detecting a signal is initially set to the lowest level where the amplitude of a signal received from an EAS tag is not trimmed (step S102). The receiver 14 receives a signal during a receive window (step S104). The sequence detector 26 determines whether the amplitude of the received signal, RX_AMP, is greater than the threshold amplitude 27 (step S106). If the received signal amplitude is less than the threshold amplitude, the EAS system is not experiencing interference during the present receive window and the sequence detector 26 cycles back in preparation to receive a signal during the next receive window. However, if the received signal is greater than the threshold amplitude 27, the sequence detector 26 uses the received signal to update the current received pattern 29 (step S108). The sequence detector 26 compares the current pattern 29 of received signals to at least one reference pattern 28 of aiding transmit windows (step S110). If the current received pattern 29 matches a reference pattern 28 (step S112), the sequence detector 26 uses the reference pattern 28 to predict when the interfering system will be transmitting and trims samples obtained during those timeframes from processing (step S114), thereby effectively preventing those false signals from being interpreted as a signal received from an EAS tag or Noise. The reference pattern 28 may include only aiding patterns, or a combination of aiding and figure-8 patterns. The sequence detector 26 may use a reference pattern that includes only aiding patterns to trim all interfering signals, i.e., both aiding and figure-8. Also, any signal that is not trimmed, but is during a noise window is used to calculate noise statistics. The majority of the performance gains due to the algorithms is due to the fact that trimmed windows are not affecting the noise calculations, therefore not increasing the noise incorrectly.

Figure 5:
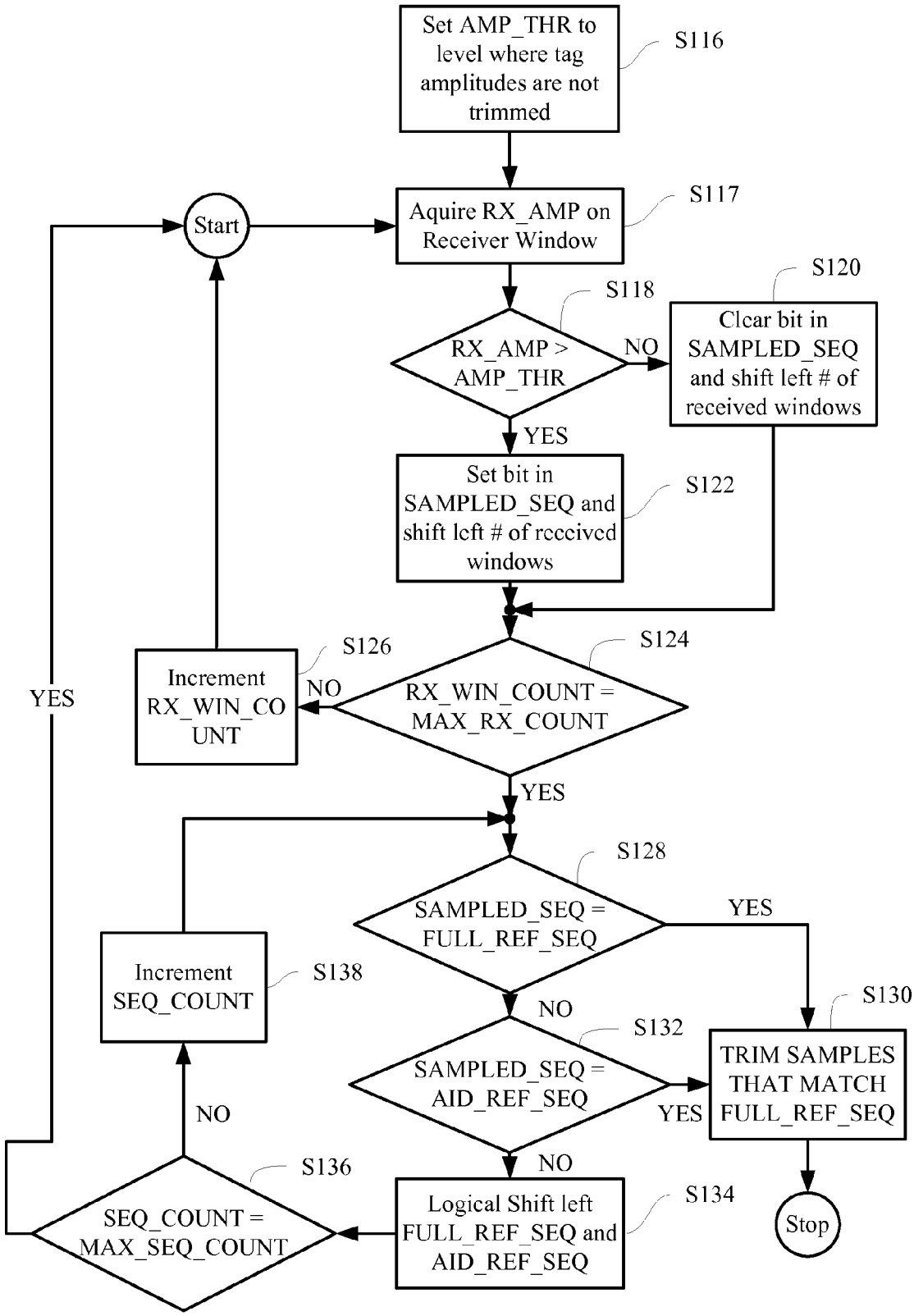
FIG. 5 is a flow chart of an exemplary frame pattern detection process according to the principles of the present invention.

Referring now to FIG. 5, an exemplary operational flowchart is provided that describes steps performed by the sequence detector 26 to recognize a transmit pattern received from an interfering EAS system. The process begins by setting the threshold amplitude 27 to a level above which the signals received from EAS tags are trimmed (step S116), ensuring that no actual tag signals are missed. This level may be determined experimentally as the maximum amplitude possibly received from an EAS. The receiver 14 receives a signal during a receive window (step S117) and determines the amplitude of the received signal, RX_AMP. The sequence detector 26 determines whether the amplitude of the received signal is greater than the threshold amplitude 27 (step S118). If the received signal amplitude is less than the threshold amplitude, the sequence detector 26 clears the bit corresponding to the present receive window in the current pattern 29, SAMPLED_SEQ, and shifts left the number of receive windows received (step S120). However, if the received signal is greater than the threshold amplitude 27 (step S118), the sequence detector 26 sets the bit corresponding to the present window in the current pattern 29 and shifts left the number of receive windows (step S122).

Next, the sequence detector 26 determines whether the number of receive windows processed, i.e., RX_WIN_COUNT, is equal to the maximum number of receive windows used to create the sampled sequence (step S124). If not, the number of receive windows processed is incremented by one (step S126) and the sequence detector 26 cycles back in preparation to receive a signal during the next receive window. However, if the maximum number of receive windows has been reached (step S124), the sequence detector 26 compares the complete current receive pattern 29 to a full pattern reference sequence, FULL_REF_SEQ (step S128). If the patterns match, the sequence detector 26 trims samples obtained during those timeframes that match the full reference pattern from processing (step S130). If the patterns do not match (step S128), the sequence detector 26 compares the complete current receive pattern 29 to aiding pattern references sequence, AID_REF_SEQ, (step S130) which correlates to the full reference pattern. If these patterns match, the sequence detector 26 trims samples obtained during those timeframes that match the full reference pattern corresponding to the aiding reference pattern from processing (step S130). If the patterns do not match (step S132), the sequence detector 26 performs a logical shift left to both the full reference pattern and the corresponding aiding reference pattern (step S134) to include all possible variations due to system timing.

The sequence detector 26 determines whether the all possible variations of the reference sequence 28 have been compared, i.e., the sequence count, SEQ_COUNT=MAX_SEQ_COUNT, (step S136). If not, the number of sequence count is incremented by one (step S138) and the sequence detector 26 cycles back to decision block S128 to compare the current received pattern to the reference patterns 28. When all variations of the reference pattern have been exhausted, the sequence detector 26 cycles to begin receiving a new set of signals during the next receive window.

Figure 6:
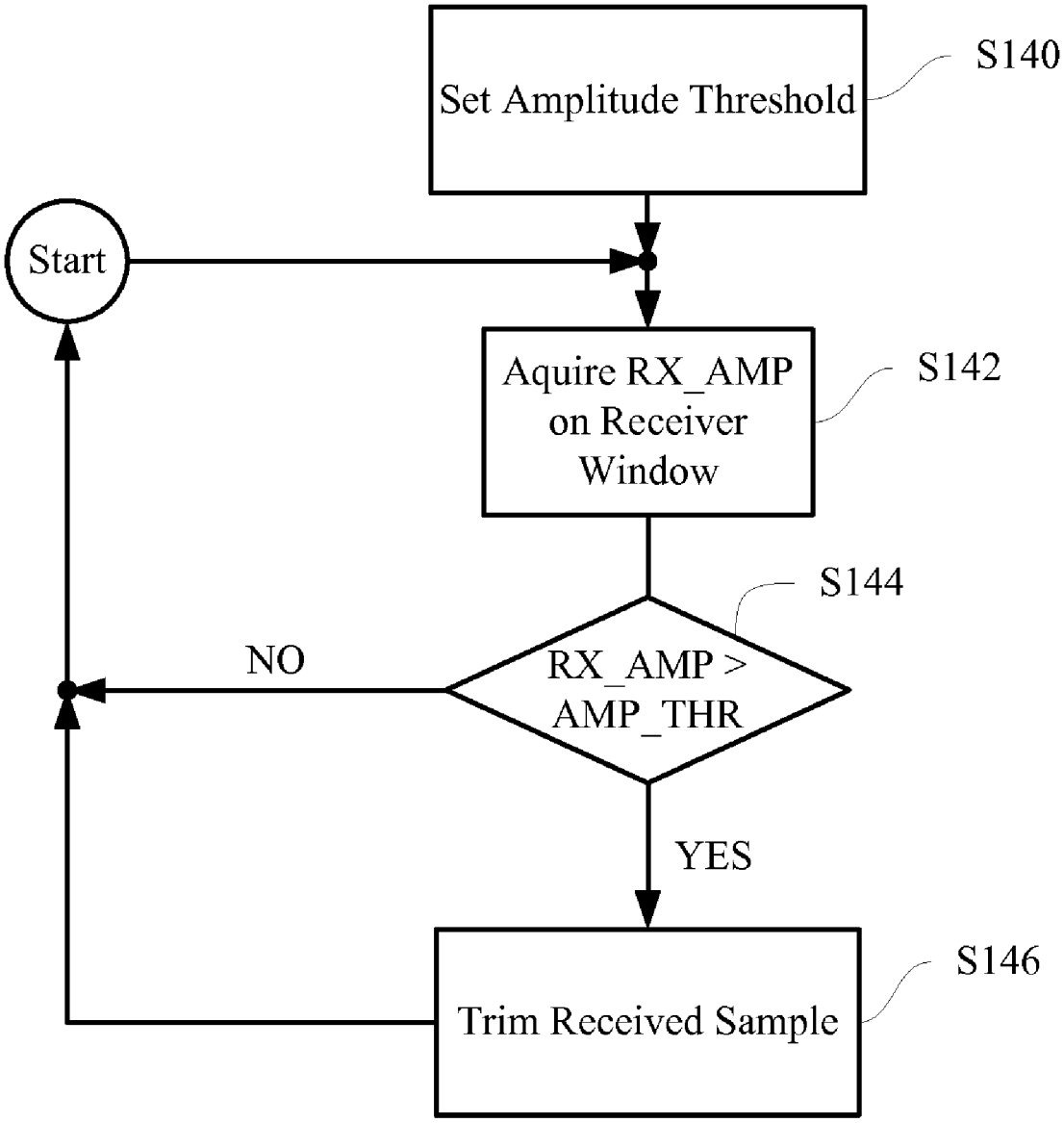
FIG. 6 is a flow chart of an exemplary excess energy detection process according to the principles of the present invention.

Referring now to FIG. 6, an exemplary operational flowchart is provided that describes steps performed by the sequence detector 26 to recognize interfering transmissions without determining an actual transmission pattern. This process is useful when the interfering signal is created by an asynchronous EAS system, wherein there is no set transmission pattern. Instead, this process focuses on the presence of excess energy to determine whether to trim a signal from the processing stages. In other words, received signals that have more energy than would normally be detected from an EAS tag are not used for tag detection or for background noise calculations. Alternatively, the process described in FIG. 6 may be used in conjunction with the processes of FIGS. 4 and/or 5 to trim signals having excess energy when no corresponding pattern may be determined.

The process begins by setting the threshold amplitude 27 to a level below which the signals received from EAS tags are trimmed (step S140), ensuring that no actual tag signals are missed. The receiver 14 receives a signal during a receive window (step S142) and determines the amplitude of the received signal, RX_AMP. The sequence detector 26 determines whether the amplitude of the received signal is greater than the threshold amplitude 27 (step S144). If the received signal amplitude is less than the threshold amplitude, the EAS system is not experiencing interference during the present receive window and the sequence detector 26 cycles back in preparation to receive a signal during the next receive window. However, if the received signal is greater than the threshold amplitude 27 (step S144), the sequence detector 26 trims the received sample from processing (step S146). Thus, the EAS system only uses samples that could have reasonably been generated by an EAS tag to detect a tag. In other words, the EAS system determines whether an EAS tag is present in the detection zone considering only the non-discarded signals. Also, any signal that is not trimmed but is a noise window is used to calculate noise statistics.

The present invention can be realized in hardware, software, or a combination of hardware and software. Any kind of computing system, or other apparatus adapted for carrying out the methods described herein, is suited to perform the functions described herein.

A typical combination of hardware and software could be a computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A method for reducing interference among multiple independent electronic article surveillance ("EAS") systems, each EAS system including a corresponding detection zone, the method comprising:

providing at least one reference pattern of transmission windows for an interfering EAS system, the at least one reference pattern indicating a sequence of time slots for which the interfering EAS system is transmitting;

receiving a sample pattern of signals, each signal having a corresponding amplitude;

comparing the received sample pattern to the at least one reference pattern; and responsive to determining that the received sample pattern matches the at least one reference pattern, using the at least one reference pattern to trim samples received during receive windows corresponding to the time slots for which the interfering EAS system is transmitting to reduce interference among each EAS system.

2. The method of claim 1, further comprising determining whether an EAS tag is present in the corresponding detection zone without considering the trimmed samples.

3. The method of claim 1, wherein the sample pattern of signals includes a sequence of bits, each bit representing one receive window, the method further comprising determining whether the amplitude of a received signal exceeds a predetermined threshold.

4. The method of claim 3, wherein the predetermined threshold is at least equal to a maximum amplitude received from an EAS tag.

5. The method of claim 3, further comprising, a responsive to determining the amplitude of the received signal exceeds the predetermined threshold, setting a corresponding bit in the sequence of bits.

6. The method of claim 3, further comprising, responsive to determining the amplitude of the received signal does not exceed the predetermined threshold, clearing a corresponding bit in the sequence of bits.

7. The method of claim 1, wherein the interfering EAS system may transmit in an aiding configuration and a figure-8 configuration, the reference pattern including aiding samples and figure-8 samples.

8. The method of claim 1, wherein the interfering EAS system may transmit in an aiding configuration and a figure-8 configuration, and wherein the reference pattern does not include figure-8 samples, the method further comprising:

correlating the reference pattern to a full reference pattern, the full reference pattern including aiding samples and figure-8 samples; and trimming samples received during receive windows corresponding to the time slots for which the interfering EAS system is transmitting in the aiding configuration and in the figure-8 configuration.

9. The method of claim 8, further comprising:

determining whether an EAS tag is present in the corresponding detection zone without considering the trimmed samples.

10. The method of claim 1, wherein responsive to determining that the received sample pattern does not match the at least one reference pattern, the method further comprising:

determining that the amplitude of at least one received signal exceeds a predetermined threshold; discarding the at least one received signal that is determined to have an amplitude that exceeds the predetermined threshold; and determining whether an EAS tag is present in the corresponding detection zone without considering the at least one discarded signal.

11. An electronic article surveillance ("EAS") system comprising: a transmitter operable to transmit interrogation signals to excite an EAS tag within a detection zone; a receiver operable to receive a sample pattern of signals, each signal having a corresponding amplitude; a memory, the memory including at least one reference pattern of transmission windows for an independent interfering EAS system, the at least one reference pattern indicating a sequence of time slots for which the interfering EAS system is transmitting; and a controller electrically coupled to the transmitter, the receiver, and the memory, the controller operable to: compare the received sample pattern to the at least one reference pattern; and responsive to determining that the received sample pattern matches the at least one reference pattern, using the at least one reference pattern to trim samples received during receive windows corresponding to the time slots for which the interfering EAS system is transmitting to reduce interference with the interfering EAS system.

12. The electronic article surveillance system of claim 11, wherein the controller is further operable to determine whether an EAS tag is present in the detection zone without considering the trimmed samples.

13. The electronic article surveillance system of claim 11, wherein the sample pattern of signals includes a sequence of bits, each bit representing one receive window, the controller is further operable to determine whether the amplitude of a received signal exceeds a predetermined threshold.

14. The electronic article surveillance system of claim 13, wherein the predetermined threshold is greater than or equal to a maximum amplitude received from an EAS tag.

15. The electronic article surveillance system of claim 13, wherein responsive to determining the amplitude of the received signal exceeds the predetermined threshold, the controller is further operable to set a corresponding bit in the sequence of bits.

16. The electronic article surveillance system of claim 13, wherein responsive to determining the amplitude of the received signal does not exceed the predetermined threshold, the controller is further operable to clear a corresponding bit in the sequence of bits.

17. The electronic article surveillance system of claim 11, wherein the interfering EAS system may transmit in an aiding configuration and a figure-8 configuration, the reference pattern includes aiding samples and figure-8 samples.

18. The electronic article surveillance system of claim 11, wherein the interfering EAS system may transmit in an aiding configuration and a figure-8 configuration, and wherein the reference pattern does not include figure-8 samples, the controller is further operable to:

correlate the reference pattern to a full reference pattern, the full reference pattern including aiding samples and figure-8 samples; and trim samples received during receive windows corresponding to the time slots for which the interfering EAS system is transmitting in the aiding configuration and in the figure-8 configuration.

19. The electronic article surveillance system of claim 11, wherein responsive to determining that the received sample pattern does not match the at least one reference pattern, the controller is further operable to:

determine that the amplitude of at least one received signal exceeds a predetermined threshold;

discard the at least one received signal that is determined to have an amplitude that exceeds the predetermined threshold;

determine whether an EAS tag is present in the detection zone considering only the non-discarded signals.

* * * * *